US009795528B1

(12) United States Patent
Delmestri et al.

(10) Patent No.: US 9,795,528 B1
(45) Date of Patent: Oct. 24, 2017

(54) BARIATRIC LIFT CHAIR

(71) Applicants: Fabio G. Delmestri, High Point, NC (US); Zachary Gray Cashatt, Pleasant Garden, NC (US)

(72) Inventors: Fabio G. Delmestri, High Point, NC (US); Zachary Gray Cashatt, Pleasant Garden, NC (US)

(73) Assignee: Images of America, Inc., Thomasville, NC (US)

( * ) Notice: Subject to any disclaimer, the term of this patent is extended or adjusted under 35 U.S.C. 154(b) by 53 days.

(21) Appl. No.: 14/933,338

(22) Filed: Nov. 5, 2015

(51) Int. Cl.
*A61G 5/14* (2006.01)
*A61G 5/04* (2013.01)
*A61G 5/10* (2006.01)

(52) U.S. Cl.
CPC ..... *A61G 5/14* (2013.01); *A61G 5/04* (2013.01); *A61G 5/104* (2013.01)

(58) Field of Classification Search
USPC ..... 297/85 M, 330, DIG. 10
See application file for complete search history.

(56) References Cited

U.S. PATENT DOCUMENTS 4,249,774 A * 2/1981 Andreasson ..... A61G 5/14 297/311
4,852,939 A * 8/1989 Krauska ..... A47C 1/0242 297/330
4,909,569 A * 3/1990 Gaffney ..... A47C 1/0342 297/327
4,949,408 A * 8/1990 Trkla ..... A61G 5/006 297/DIG. 4
5,108,202 A 4/1992 Smith
5,651,580 A * 7/1997 LaPointe et al. .... A47C 1/0355 297/325
5,984,411 A * 11/1999 Galumbeck ..... A61G 5/14 297/330
5,992,931 A * 11/1999 LaPointe et al. .... A47C 1/0345 297/330
6,089,593 A * 7/2000 Hanson et al. ..... A61G 5/006 280/250.1
6,142,568 A * 11/2000 Abelbeck et al. ... A61G 5/1059 297/330
6,886,194 B2 * 5/2005 Hodgetts ..... A61G 5/006 280/648
6,957,461 B2 * 10/2005 Osborne ..... A61G 7/0528 5/600
7,661,696 B1 2/2010 Acebo
7,766,421 B2 * 8/2010 Lawson ..... A47C 1/0355 297/84

(Continued)

*Primary Examiner* — Sarah McPartlin
(74) *Attorney, Agent, or Firm* — Tuggle Duggins P.A.; Blake Hurt

(57) ABSTRACT

A bariatric chair for use in easing the ingress and egress of bariatric patients from medical furniture includes a platform mounted within a cavity defined by the chair base. The platform includes a pair of pistons and a pair of legs each pivotably attached to a rectangular base that is stored in a retracted position within the base when not in use but drops down when engaged to lift the chair vertically. Due to the pistons extending beyond the legs, the pivotable nature of the attachment creates a rotation of approximately fifteen degrees (15°) in the chair base, assisting the bariatric patient when trying to exit the chair. A method of lifting the chair is also provided.

18 Claims, 4 Drawing Sheets

(56) References Cited

U.S. PATENT DOCUMENTS

| | | | | |
|---|---|---|---|---|
| 8,973,997 | B2 * | 3/2015 | Green | A61G 5/1067 297/284.11 |
| 2001/0035668 | A1 * | 11/2001 | Gaffney et al. | A47C 1/0345 297/85 M |
| 2002/0063459 | A1 * | 5/2002 | Gaffney et al. | A47C 1/0345 297/330 |
| 2002/0101102 | A1 * | 8/2002 | Chang | A61G 5/14 297/330 |
| 2004/0174058 | A1 * | 9/2004 | Meyer | A61G 5/14 297/340 |
| 2006/0061148 | A1 * | 3/2006 | Pollard | A47C 1/0355 297/85 M |
| 2006/0076813 | A1 * | 4/2006 | Mohn | A61G 5/14 297/330 |
| 2006/0220350 | A1 | 10/2006 | Reef et al. | |
| 2006/0238007 | A1 * | 10/2006 | Lin | A61G 5/14 297/330 |
| 2011/0049963 | A1 * | 3/2011 | Shih | A47C 1/0345 297/85 M |
| 2011/0248547 | A1 * | 10/2011 | LaPointe | A47C 1/0355 297/85 R |
| 2011/0291460 | A1 * | 12/2011 | Murphy | A61G 5/14 297/85 M |
| 2012/0286557 | A1 * | 11/2012 | Hoffman | A47C 1/0355 297/85 M |
| 2012/0299363 | A1 * | 11/2012 | Crum | A47C 1/0355 297/85 M |
| 2013/0175847 | A1 * | 7/2013 | Lawson | A61G 5/14 297/85 M |

* cited by examiner

BARIATRIC LIFT CHAIR

FIELD OF THE INVENTION

The invention herein pertains to medical furniture and particularly pertains to a bariatric chair with a descending platform and a motorized lift for raising and angling the chair to ease ingress and egress therefrom.

DESCRIPTION OF THE PRIOR ART AND OBJECTIVES OF THE INVENTION

The increasing weight and age of the typical American citizen is creating new challenges in the field of medical equipment, particularly in the field of bariatrics. Bariatric patients often have an abundance of body mass positioned around the lower torso (e.g. hip, waist, buttocks, thighs, etc.) which protrudes outward from the perimeter of the lower body. This unwieldy body mass is a significant hindrance to mobility on its own, and when coupled with older age, declining muscular strength, arthritic joints, and other maladies of advanced age, may render a patient nearly immobile. Therefore, it becomes increasingly necessary to provide physical assistance, often in the form of manual engagement such as by a nurse or orderly, to permit the bariatric patient to perform even the most rudimentary tasks. While this is a known hazard of working with bariatric patients, repeated attempts to assist a patient in entering or exiting the bed, using the bathroom, utilizing a bath or shower, and countless other daily events can physically exhaust the assistant and potentially lead to injury, both to the patient and the assistant.

In view of this challenge, various solutions have been developed and are known in the prior art, particularly in the form of a chair design for use with bariatric patients. For example, see U.S. Pat. No. 7,661,696 to Acebo and U.S. Patent Publication No. 2006/0220350 to Reef for two examples of chairs that pivot from a substantially vertical orientation to support a patient while sitting to a substantially horizontal position to support the patient while laying on the back, for example during examination. While these chairs are useful in some circumstances, they fail to alleviate the strain on the assistant as described previously when the patient wishes to exit the chair. Another attempt in the prior art is evidenced in U.S. Pat. No. 5,108,202 to Smith, which discloses a chair similar to a conventional wheel chair equipped with pivotable back and seat members and a lifting jack to rotate the patient into a substantially standing position. However, this solution is unlikely to be helpful to the patient, as the patient's center of gravity is positioned far rearward of the chair for a majority of the pivoting action, forcing the patient to overcome the vertical barrier. Further, while Smith claims to utilize a brake device, no such security measure is shown, creating a likelihood that the Smith device may tend towards inadvertent movement, particularly in view of the substantial weight common in bariatric patients and potentially exacerbated by even the slightest grade. Therefore, there exists a need for an improved bariatric chair that can aid the patient in the comfortable and efficient ingress and egress of the chair.

Thus, in view of the problems and disadvantages associated with prior art devices, the present invention was conceived and one of its objectives is to provide a medical chair that lifts off the ground to assist a patient with ingress and egress therefrom.

It is another objective of the present invention to provide a chair with a deployable platform that lifts the chair vertically off the ground, floor, or the like.

It is still another objective of the present invention to provide a chair with a deployable platform that rotates the chair approximately fifteen degrees (15°) from the horizon.

It is yet another objective of the present invention to provide a chair with a platform pivotally attached to the chair base and powered by an electronic lift to raise the chair vertically off the ground.

It is a further objective of the present invention to provide a chair with a platform that retracts into the base of the chair when not in use, permitting free movement of the chair, for example on wheels.

It is still a further objective of the present invention to provide a chair that is easy to manufacture and simple to use.

It is yet a further objective of the present invention to provide a chair capable of lifting and pivoting a patient of substantial size and weight while remaining securely in place.

Various other objectives and advantages of the present invention will become apparent to those skilled in the art as a more detailed description is set forth below.

SUMMARY OF THE INVENTION

The aforesaid and other objectives are realized by providing a medical chair with a base defining a substantially hollow internal cavity, a pair of anus, and attached to a cushioned back. An attachment linkage is positioned within the cavity and rotatably connected to a platform. The platform includes a generally rectangular base, a pair of legs opposingly affixed to the linkage and the base, and a lift with a piston that drives the legs from a first, substantially horizontal position whereby the piston is retracted and the base is stored substantially within the internal base cavity to a second, generally orthogonal position whereby the piston is extended and the base is lowered into a contact position with the floor, ground, or the like to lift and pivot the chair, making ingress or egress from the chair substantially easier for a patient.

DETAILED DESCRIPTION OF THE PREFERRED EMBODIMENT AND OPERATION OF THE INVENTION

Figure 1:
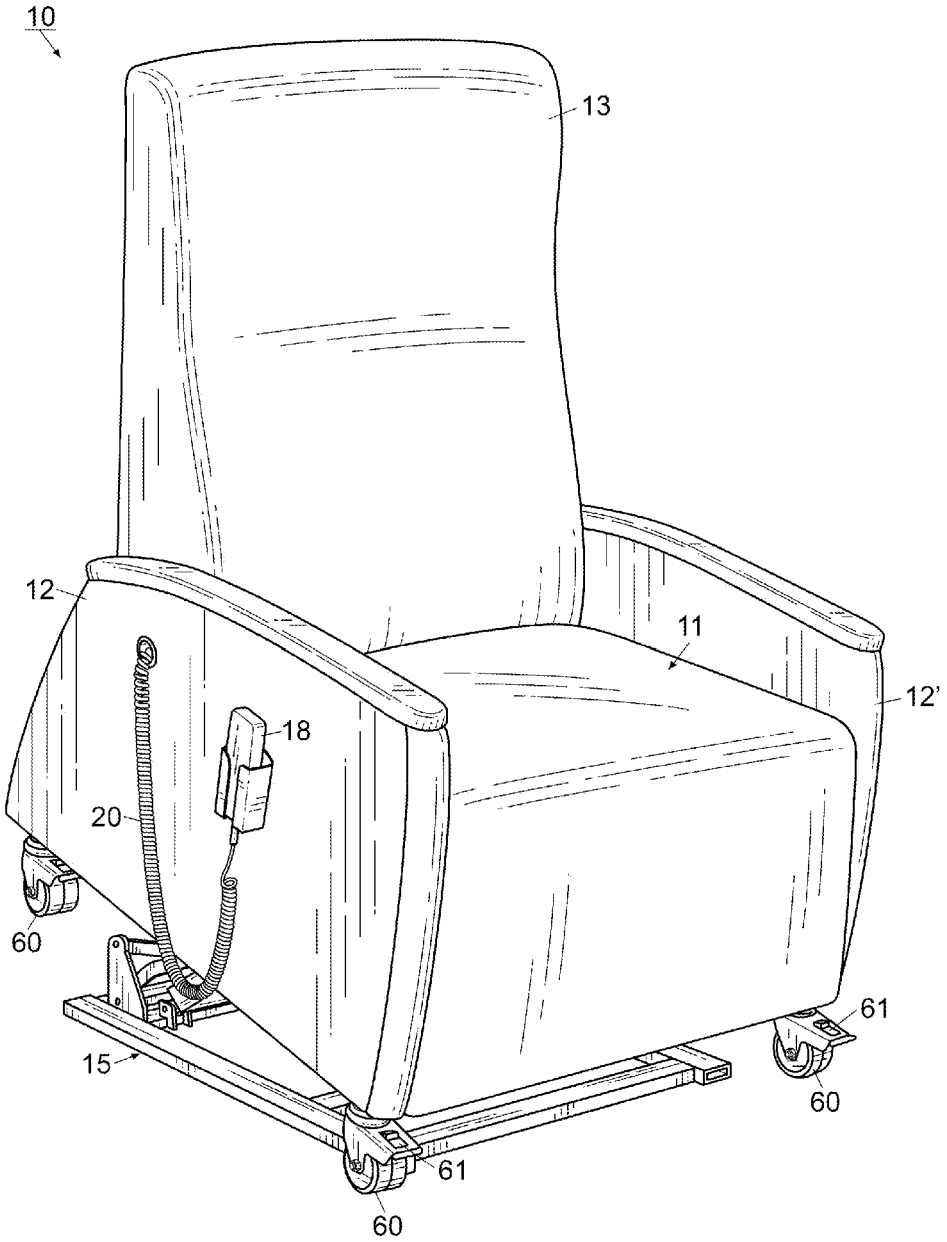
FIG. 1 shows a side perspective view of a medical chair with a lifting mechanism in an extended position.
Figure 2:
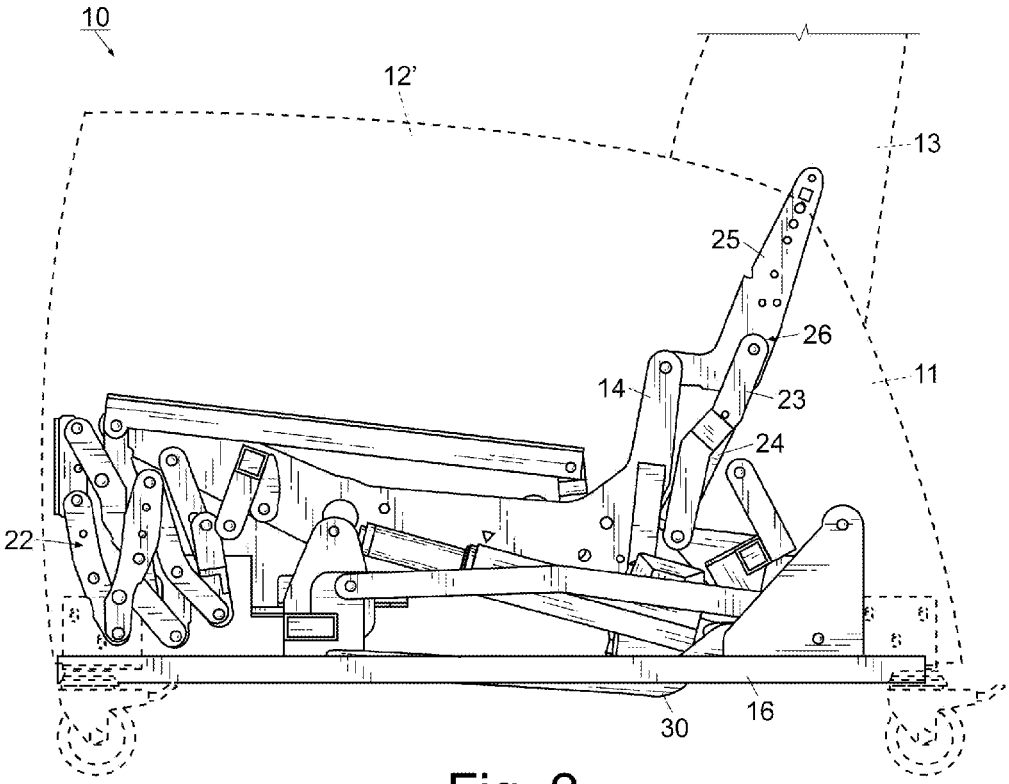
FIG. 2 pictures an elevated side view of the mechanism of FIG. 1 in a collapsed position.
Figure 3:
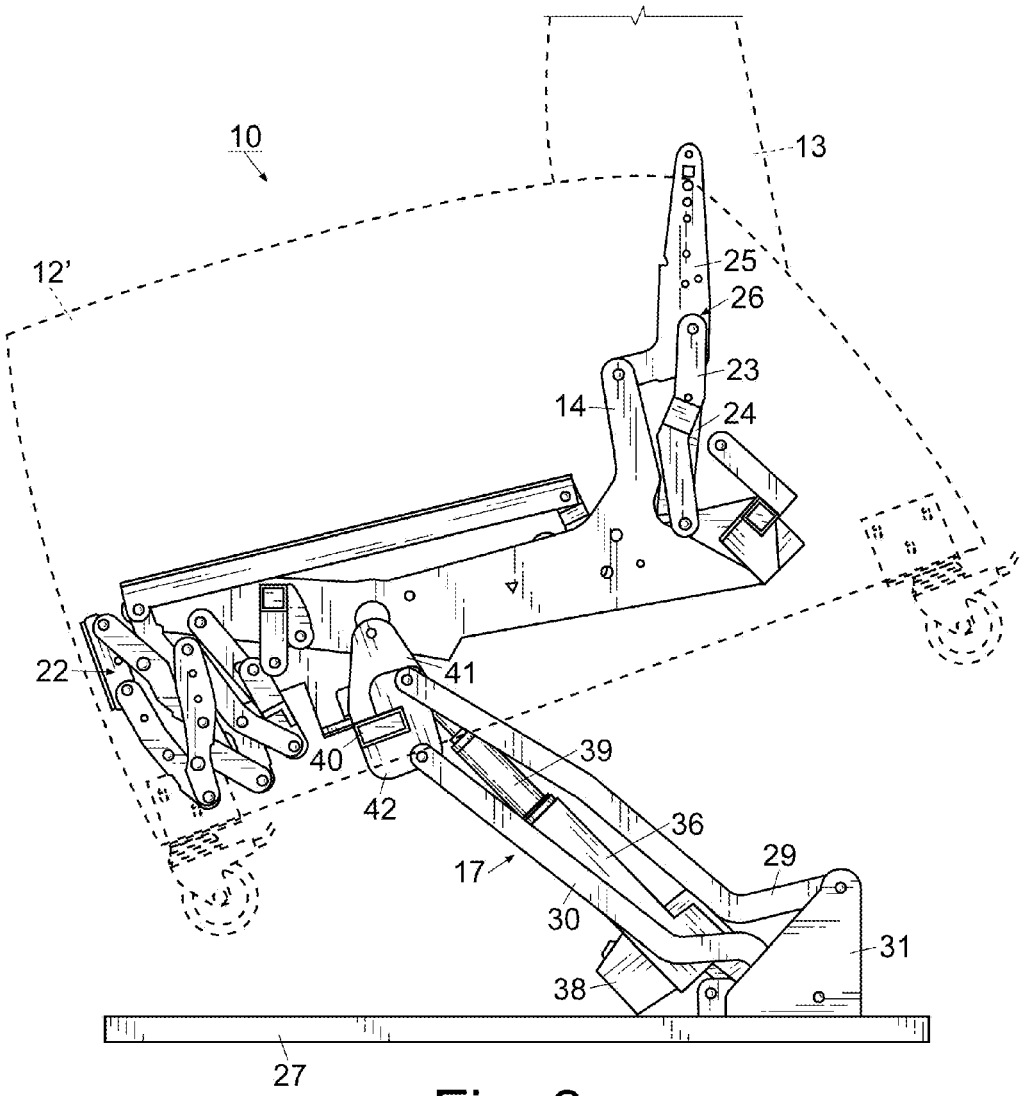
FIG. 3 depicts an elevated side view of the mechanism of FIG. 2 in an extended position.

For a better understanding of the invention and its operation, turning now to the drawings, FIGS. 1-4 demonstrate the preferred embodiment of medical chair 10. Through the description of chair 10, the term "chair" will be used but it should be understood that other commonly known furniture designs such as benches, love seats, small sofas, stools, beds, gurneys, and the like are within the intended scope of the instant invention. Preferred medical chair 10 is formed from rigid steel to provide for support of different weights and stability during repeated use, though aluminum or other materials as suitable may also be used. Preferred medical chair 10 includes base 11 defining aims 12, 12' on either side of the sitting area and back 13 that is pivotably attached to base 11 as will be described in further detail below. FIG. 1 illustrates chair 10 as an upholstered piece of furniture, and it should be understood that a variety of coverings such as fabric, leather, microfiber, and the like are within the contemplation of appropriate coverings of chair 10. By comparison, FIGS. 2-3 display chair 10 in phantom view and without the presence of any upholstery covering. The structural orientation of base 11 creates a substantially hollow interior cavity that is sized and shaped to receive and store main plate 14. As will be described in further detail below, main plate 14 (see FIG. 2) is formed from a rigid material such as metal and serves as the attachment scaffolding for pivoting back 13 and retractable platform 15. Platform 15 is formed from platform base 16 and rotatably affixed platform legs 17, 17' opposingly attached to main plate 14 and base 16. FIG. 1 also shows controller 18 in electronic communication with lift 21 powered by actuators 38, 38' via cord 20 (see FIG. 4). Controller 18 allows a patient or assistant to operate platform 15 from the stored position (FIG. 2) to the extended position as shown in FIGS. 1 and 3. Chair 10 also preferably includes caster-type wheels 60 located at the respective corners of the generally rectangular bottom surface of base 11 and attached via associated wheel brackets to allow chair 10 to move from one location to another, even with a person sitting thereon. Wheels 60 may also include wheel locks 61, which preferably are a slide-type locking mechanism for secure positioning and restricting the movement of chair 10 when platform 15 is in the retracted or stored position.

The preferred embodiment of chair 10 also includes extender 22 pivotally mounted to main plate 14 within base 11. Extender 22 is a linkage formed from a plurality of pivotably connected, ovular members that cooperatively rotate from a first, stored position (see FIGS. 2 and 3), to a second, extended position (not shown) that creates an elevated foot platform to increase comfort level and improve circulation of the patient. Only one extender 22 is shown (see FIGS. 2 and 3) but it should be understood that a pair of extenders 22 connected by a laterally extending foot base would be utilized in connection with preferred chair 10. An embodiment of chair 10 may also include pivotable back 13, which utilizes back legs 23 and 24 and back brace 25 to form pivotally interconnected back linkage 26 that is rotatably connected to chair main plate 14, allowing a user to recline back 13 from a substantially vertical orientation to a substantially horizontal orientation as desired (not shown). Similar to extender 22, it should be understood that FIGS. 2 and 3 are single side views of chair 10, indicating that another main plate 14 and back linkage 26 may be positioned on the opposing side of chair 10. As shown in FIGS. 2 and 3, extender 22 and back linkage 26 are pivotally interconnected with a series of mechanical fasteners as would be understood by one of ordinary skill in the art, and are therefore not described in further detail.

FIG. 2 is an elevated side view of chair 10 with the exterior represented in dotted fashion and platform 15 in the retracted, stored position substantially within a cavity formed by base 11. In this orientation, base 16 is positioned generally parallel to the floor. As seen more clearly in FIG. 4, base 16 is preferably forming from a pair of longitudinal members 27, 27' rigidly attached at opposing ends by one or more lateral members 28, 28', creating a generally rectangular spatial footprint. While other structural shapes are acceptable, the rectangular orientation is preferred to provide a stable platform for chair 10, particularly in the raised position as the center of gravity while supporting a patient moves vertically (up) and longitudinally (forward). An embodiment of chair 10 may include additional lateral members 28 inter-disposed between terminal members 28 and 28' for increased structural integrity and stability. Longitudinal members 27, 27' and lateral members 28, 28' may define a tubular cross-sectional shape and are preferably forming from a rigid material such as metal. It should be understood that while longitudinal members 27, 27' and lateral members 28, 28' may be affixed by mechanical fasteners or adhesives, the preferred attachment method is to weld the respective terminal ends of lateral members 28, 28' to longitudinal members 27, 27', creating a solid, permanent attachment therebetween to provide a chair with a weight capacity of 750 lb capable of stand assist lifting a user.

Figure 4:
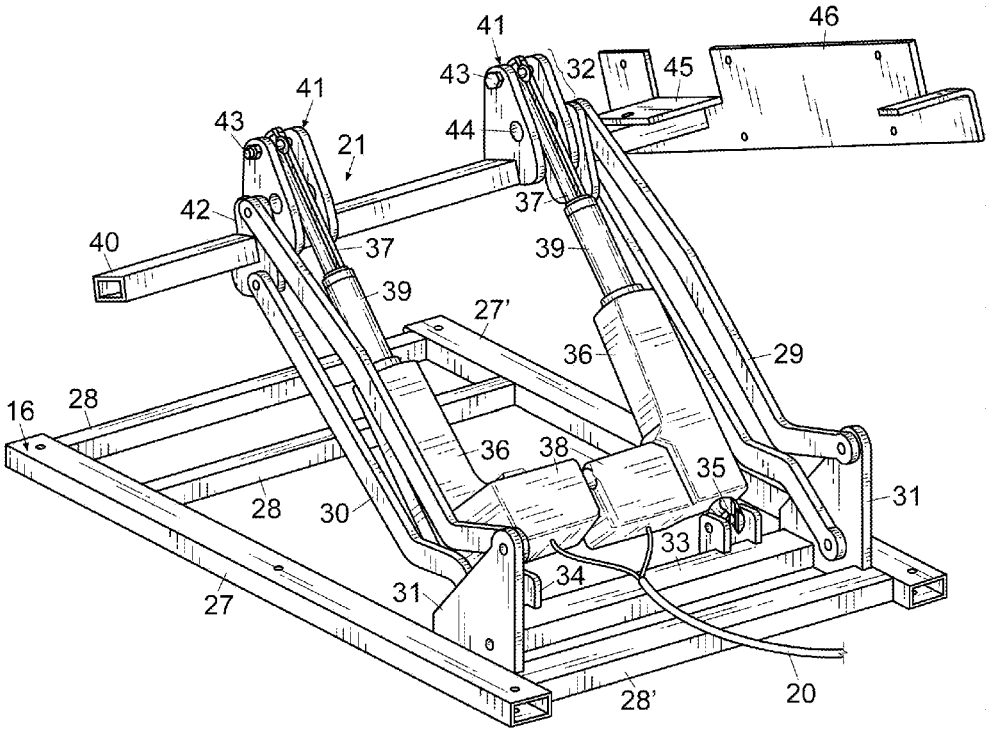
FIG. 4 demonstrates a perspective rear view of the lifting mechanism in an extended position as removed from the chair.

FIG. 3 presents an elevated side view of chair 10 with the exterior of chair 10 shown in dotted fashion and platform 15 in the extended, deployed position against the floor causing base 11 to rise above the floor and pitch forward. With platform 15 so engaged, chair 10 is prevented from sliding, rolling or otherwise as lift 21 extends to lift base 11 and an occupant (not shown) from a sitting to a standing position for safely exiting the chair. FIG. 4 displays a rear perspective view of lift 21 in the extended position with the remainder of chair 10 cut away. Lift 21 is positioned between base longitudinal members 27, 27' and somewhat rearward in relation to base lateral members 28, 28'. Lift 21 includes pivotable legs 17, 17', each defined by upper strut 29 and lower strut 30. Both upper strut 29 and lower strut 30 preferably define a generally L shape, although the geometry of struts 29 and 30 may also include a slight bend in the opposite direction resembling the L, with upper strut 29 defining this opposing bend in the "long" section of the L and lower strut 30 defining the bend in the "short" section of the L. This geometry and orientation permits upper strut 29 and lower strut 30 to be positioned closely together without contacting the other member during movement. Each leg 17, 17' is pivotably attached and disposed between different ones of base brackets 31 and mount assemblies 32. Base brackets 31 may define a generally triangular shape and are positioned between and rigidly attached to base longitudinal members 27, 27'. Base brackets 31 define a plurality of apertures to pivotally connect upper strut 29 and lower strut 30, and may further define a notch sized and positioned to receive base lateral member 28' therein for increased structural strength. Similarly, for added integrity bar 33 may be rigidly affixed laterally between brackets 31 to prevent any inadvertent displacement of lift 21. Bar 33 also serves as the attachment scaffold for a pair of piston brackets 34. Each piston bracket 34 defines a generally U-shaped cross-section and includes a notch along the bottom to receive bar 33 therein. The U-shaped cross-section defines a central channel in piston bracket 34 that is sized and positioned to accommodate rotatable nut 35 therein.

Each nut 35 is positioned on the exterior, rear-facing surface of piston housing 36 and serves as a manual release to piston 37 in the event actuator 38 loses the ability to deploy and retract piston 37, for example if chair 10 experiences a loss of electrical power, air pressure, oil pressure, or the like. Each piston housing 36 includes piston sleeve 39 for storing piston 37 within when platform 15 is in the retracted position (FIG. 2) and is positioned opposite nut 35. Correspondingly, piston 37 is sized and shaped to insert substantially within piston sleeve 39 when platform 15 is in the retracted position. Actuator 38 is preferably an electric motor capable of driving piston 37 from a stored position to an extended position, but it should be understood that actuator 38 may also be a screw drive, air lift, oil lift, or any other lifting mechanism capable of driving piston 37 from a stored position to an extended position.

Piston 37 is rotatably attached to transverse bar 40 for elevating chair base 11 from a seated position to a lifting, ingress and egress position. Preferably, pistons 37 are each rotatable attached to different ones of mount assemblies 32 which are each formed from transverse bracket 41 and leg mount 42. Leg mount 42 defines a generally C shape and utilizes the notch formed therein to rigidly engage transverse bar 40 and is the pivotal connection point for upper strut 29 and lower strut 30. Transverse bracket 41 is larger than leg mount 42 and is fondled from a pair of opposing plates defining the same shape with apertures 44 therein and which are spaced apart to form a channel therebetween for receiving a portion of piston 37 when chair 10 is in the elevated position. Each transverse bracket 41 is rigidly attached to transverse bar 40 at a notch in the lower portion and piston 37 is pivotably affixed thereto with transverse rod 43 through a pair of apertures 44 located proximate the apex of each plate in transverse bracket 41 as seen in FIG. 4. Due to the fact that pistons 37 extend a length greater than legs 17, 17' from the rear of platform base 16, transverse bar 40 also serves as a rotational stop for chair base 11, limiting the rotational range of mount assemblies 32 to less than twenty degrees (20°) and more preferably about fifteen degrees (15°). Transverse bar 40 is attached at opposing ends to respective tabs 45 defined by mounting plate 46, although only one mounting plate is shown in the figures for clarity as would be understood a mirror image is affixed to the opposing side for proper operation. Although not shown for the sake of brevity, main plate 14 is affixed to mounting plate 46, for example with mechanical fasteners, such that the lifting force of transverse bar 40 supplied by pistons 37 and transferred from actuators 38 is applied to chair base 11 as illustrated.

A method of elevating a medical chair for easing ingress or egress by a patient includes the step of providing chair 10 as previously described, including chair base 11 defining side arms 12, 12' and pivotably attached to back 13. Platform 15 is attached to the bottom of chair 10 and positioned substantially within a cavity defined by chair base 11 in a first, stored position whereby platform base 16 is retracted and positioned substantially parallel to the floor or other supporting substrate. A user may manually engage controller 18, for example by pushing a button, which communicates an electronic signal to actuators 38 to lower lift 21 from its retracted, stored position to a more extended configuration to engage with the floor. Mounting plates 46 are affixed to main plates 14, themselves attached to the interior surface of chair base 11, via perpendicularly oriented tabs 45 and mechanical fasteners which are also secured at opposing ends of transverse bar 40. Pistons 37 are rotatably connected to different ones of transverse brackets 41 that are mounted to transverse bar 40. As platform base 16 is lowered, pistons 37 are thereafter extended, the length of pistons 37 increases and displaces platform 15 vertically (downward) and longitudinally (rearwardly), in turn pivoting the angle of chair base 11. In the extended position, platform base 16 is flatly engaged on the floor, and legs 17, 17' formed from upper struts 29 and lower struts 30 define an angle of approximately forty-five degrees (45°), an angle shared by piston housings 36, piston sleeves 39, and extended pistons 37. Pistons 37 extend slightly forward of legs 17, 17', creating an angle of approximately fifteen degrees (15°) from the horizon as the extension causes upper strut 29, lower strut 30, and piston 37 to pivot respective leg mounts 42, transverse brackets 41, and essentially transverse bar 40, creating a slight slope in chair base 11 which aids in the ingress and egress of a patient from chair 10. This function is far more efficient than the prior art because it removes the wheels from the ground, and the lowering of the lifting mechanism takes significantly less power to securely lift a patient, even one the mass of the typical bariatric patient.

The illustrations and examples provided herein are for explanatory purposes and are not intended to limit the scope of the appended claims.

We claim:

1. A chair platform comprising a leg and an actuator pivotally disposed between a transverse bar and a platform base, the leg defining a first strut with first and second longitudinal ends and a second strut with first and second longitudinal ends, the first and second strut first ends rotatably connected to the platform base via a base bracket defining a first notch to receive a portion of a first lateral member forming the platform base therein, the first and second strut second ends rotatably connected to the transverse bar via a mounting assembly comprised of a bar bracket and a leg mount, the leg mount defining at least one notch to receive the transverse bar therein, the actuator comprising a housing and a piston, the piston defining a terminal end pivotally attached to the transverse bar via the bar bracket, the bar bracket comprising two plates spaced apart by a rod to define a channel therebetween for receiving a portion of the piston therein, each plate defining a notch to receive the transverse bar therein, wherein the chair platform is configured to operatively move from a first, retracted position to a second, extended position.

2. The chair platform of claim 1 wherein the first lateral member is attached at opposing longitudinal ends by respective first and second longitudinal members, wherein a second lateral member is attached at opposing longitudinal ends by the first and second longitudinal members and in opposing relation relative to the first lateral member, and wherein the first and second lateral members are oriented in parallel position relative to one another and the first and second longitudinal members are oriented in parallel position relative to one another, defining a rectangular shape.

3. The chair platform of claim 2 further defining one or more support bars positioned between the first and second longitudinal members and inboard of the first and second lateral members.

4. The chair platform of claim 3 wherein the base bracket defines a second notch to receive a portion of the at least one support bar therein.

5. The chair platform of claim 4 wherein the base bracket defines a generally triangular shape.

6. The chair platform of claim 1 wherein the first strut defines a generally L shape with a long portion and a short portion, and wherein the long portion defines a bend in the opposite direction relative to the direction the short leg extends from the long leg.

7. The chair platform of claim 1 wherein the second strut defines a generally L shape with a long portion and a short portion, and wherein the short portion defines a bend in the opposite direction relative to the direction the long leg extends from the short leg.

8. The chair platform of claim 1 wherein the leg mount defines a generally C shape with the notch therein to engage the transverse bar, wherein the first strut rotatably connects to the leg mount above the transverse bar, and wherein the second strut rotatably connects to the leg mount below the transverse bar.

9. A method of elevating a chair base for easing ingress and egress from the chair comprising the steps of:

providing a medical chair with the chair platform of claim 1 in communication with a controller, engaging the controller, lowering the platform from a first, stored position to a second, extended position, and vertically and pivotably displacing the chair base such that it is elevated and rotated relative to its position with the chair platform in the first position.

10. The method of claim 9 wherein displacing the chair base includes rotating the chair base approximately fifteen degrees.

11. A chair platform for a medical chair with a chair back pivotally connected to a chair base defining an internal cavity, the chair platform positioned within the internal cavity and comprising a pair of legs and a pair of actuators respectively pivotally disposed between a transverse bar and a platform base, each leg defining a first strut with first and second longitudinal ends and a second strut with first and second longitudinal ends, the first and second strut first ends rotatably connected to the platform base via a base bracket defining a first notch to receive a portion of a first lateral member forming the platform base therein, the first and second strut second ends rotatably connected to the transverse bar via a mounting assembly comprised of a bar bracket and a leg mount positioned outboard of the bar bracket, each leg mount defining at least one notch to receive the transverse bar therein, each actuator comprising a housing and a piston, the piston defining a terminal end pivotally attached to the transverse bar via the bar bracket, the bar bracket comprising two plates of the same size spaced apart by a rod to define a channel therebetween for receiving a portion of the piston therein, each plate defining a notch to receive the transverse bar therein, wherein the chair platform is configured to operatively move from a first, retracted position to a second, extended position.

12. The chair platform of claim 11 wherein the first lateral member is attached at opposing longitudinal ends by respective first and second longitudinal members, wherein a second lateral member is attached at opposing longitudinal ends by the first and second longitudinal members and in opposing relation relative to the first lateral member, and wherein the first and second lateral members are oriented in parallel position relative to one another and the first and second longitudinal members are oriented in parallel position relative to one another, defining a rectangular shape.

13. The chair platform of claim 12 further defining one or more support bars positioned between the first and second longitudinal members and inboard of the first and second lateral members.

14. The chair platform of claim 13 wherein each base bracket defines a second notch to receive a portion of the at least one support bar therein.

15. The chair platform of claim 14 wherein each base bracket defines a generally triangular shape.

16. The chair platform of claim 15 wherein the first strut defines a generally L shape with a long portion and a short portion, and wherein the long portion defines a bend in an opposite direction relative to a direction the short leg extends from the long leg.

17. The chair platform of claim 16 wherein the second strut defines a generally L shape with a long portion and a short portion, and wherein the short portion defines a bend in an opposite direction relative to a direction the long leg extends from the short leg.

18. The chair platform of claim 17 wherein the leg mount defines a generally C shape with the notch therein to engage the transverse bar, wherein the first strut rotatably connects to the leg mount above the transverse bar, and wherein the second strut rotatably connects to the leg mount below the transverse bar.

* * * * *